US010352209B2

(12) United States Patent
Solberg et al.

(10) Patent No.: US 10,352,209 B2
(45) Date of Patent: Jul. 16, 2019

(54) PRESSURE REGULATOR ASSEMBLIES

(71) Applicant: SOLBERG MANUFACTURING, INC., Itasca, IL (US)

(72) Inventors: Charles H. Solberg, Tower Lakes, IL (US); Adam Henricks, Park Ridge, IL (US)

(73) Assignee: Solberg Mfg., Inc., Itasca, IL (US)

( * ) Notice: Subject to any disclaimer, the term of this patent is extended or adjusted under 35 U.S.C. 154(b) by 38 days.

(21) Appl. No.: 15/287,237

(22) Filed: Oct. 6, 2016

(65) Prior Publication Data

US 2017/0145878 A1 May 25, 2017

Related U.S. Application Data

(60) Provisional application No. 62/301,956, filed on Mar. 1, 2016, provisional application No. 62/260,197, filed on Nov. 25, 2015.

(51) Int. Cl.

| | |
|---|---|
| ***F01M 13/02*** | (2006.01) |
| ***F01M 13/04*** | (2006.01) |
| ***B01D 45/08*** | (2006.01) |

(52) U.S. Cl.

CPC ..... *F01M 13/021* (2013.01); *F01M 13/04* (2013.01); *F01M 2013/027* (2013.01); *F01M 2013/0438* (2013.01)

(58) Field of Classification Search

CPC ..... B01D 45/08; F01M 13/02; F01M 13/04; F01M 13/0011; F01M 13/023; F01M 2013/0016; F01M 2013/0427; F01M 2013/0433; F02M 69/02

USPC ..... 55/385.3, 462; 123/198 E, 447, 573, 574

See application file for complete search history.

(56) References Cited

U.S. PATENT DOCUMENTS

| | | | |
|---|---|---|---|
| 3,108,581 | A | 10/1963 | Humphreys |
| 3,189,012 | A | 6/1965 | Humphreys |
| 3,587,628 | A | 6/1971 | Farrer et al. |
| 4,064,853 | A | 12/1977 | Matz |
| 4,295,457 | A | 10/1981 | Schleiermacher |
| 4,502,841 | A | 3/1985 | Kebedjis |
| 4,502,955 | A | 3/1985 | Schaupp |

(Continued)

OTHER PUBLICATIONS

Bryan Donkin RMG Canada Limited; Installation & Commissioning Instructions Product: Regulator With Relief Valve; Data Sheet No. CIC 9000A; Issue Date: Oct. 2006, 2 pages.

(Continued)

*Primary Examiner* — Amber R Orlando
*Assistant Examiner* — Minh Chau T Pham
(74) *Attorney, Agent, or Firm* — James B. Conte

(57) ABSTRACT

A primary housing carries an air/oil separation element. A valve member extends into a throat of the element. A secondary housing forms a regulator chamber and an atmospheric chamber. A partition of the secondary housing delimits and fluidly seals the atmospheric chamber from the regulator chamber. The partition is moveable in opposite axial directions responsive to a change in a pressure differential between the atmospheric chamber and regulator chamber without the use of a spring. The valve opens into and is in fluid connection with the regulator chamber. The secondary housing is carried by the primary housing. Alternatively, a fluid port can open up out of the secondary housing and the valve not open into the regulator chamber.

11 Claims, 9 Drawing Sheets

(56) References Cited

U.S. PATENT DOCUMENTS

| | | | | |
|---|---|---|---|---|
| 4,502,956 | A | 3/1985 | Wilson et al. | |
| 4,550,749 | A | 11/1985 | Krikorian | |
| 5,090,393 | A * | 2/1992 | Holch | F01M 13/023 123/574 |
| 5,319,949 | A | 6/1994 | Long et al. | |
| 5,347,973 | A | 9/1994 | Walker, Jr. | |
| 5,542,401 | A | 8/1996 | Newarski | |
| 5,564,401 | A * | 10/1996 | Dickson | F01M 13/023 123/573 |
| 6,216,648 | B1 | 4/2001 | Spaulding | |
| 6,422,224 | B1 | 7/2002 | Walker, Jr. | |
| 6,557,536 | B2 | 5/2003 | Burgess | |
| 6,684,865 | B2 | 2/2004 | Hilpert | |
| 7,422,612 | B2 | 9/2008 | Pietschner | |
| 8,297,264 | B2 | 10/2012 | Imhof | |
| 8,607,767 | B2 | 12/2013 | Ruppel et al. | |
| 2014/0026857 | A1* | 1/2014 | Tsutsui | F02M 69/02 123/447 |
| 2015/0345351 | A1* | 12/2015 | Mincher | B01D 45/08 55/462 |

OTHER PUBLICATIONS

Bryan Donkin USA; BD USA Model 226 Spring-Loaded Gas Pressure Regulator, Technical Manual; 13 pages, Jul. 2010.

Solberg Manufacturing, Springless Pressure Regulator with Diaphragm on sale in US, Aug. 25, 2010, Schematics, 10 pages.

Solberg Manufacturing, Springless Pressure Regulator with Diaphragm on sale in US, at least 2012, Schematics, 2 pages.

* cited by examiner

PRESSURE REGULATOR ASSEMBLIES

CROSS REFERENCE TO RELATED APPLICATIONS

This application Ser. No. 15/287,237, filed Oct. 6, 2016, claims the priority from Provisional Application 62/260,197 filed on Nov. 25, 2015 and claims priority from Provisional Application 62/301,956 filed on Mar. 1, 2016.

FIELD OF THE INVENTION

The present invention relates to engines, and more particularly, to regulating the pressure within the crankcases of internal combustion engines by means of a pressure regulator assembly for a crank case. More particularly, the regulator comprises a moveable member which cooperates with a partition to provide a variable orifice to maintain a near constant vacuum (negative pressure) in the crank case.

BACKGROUND OF THE INVENTION

Closed crankcase emission control systems require a high efficiency filter and crankcase pressure regulator. The high efficiency filter is required to filter out small sized particles to prevent contamination of the air, turbochargers, aftercooler, and internal engine components. The pressure regulator maintains acceptable levels of crankcase pressure.

In one example of the prior art, a pressure control assembly uses a diaphragm and a spring biasing means to maintain a constant vacuum in the system. The spring would cooperate with the diaphragm causing a valve within the diaphragm to move a variable orifice in order to maintain constant pressure. The problem with using a diaphragm and spring is that this type of system requires the use of a lot of small moving parts. The springs would eventually wear over time and need to be replaced before they failed.

In another example of the prior art, to make sure the vacuum in the crank case remains at a set negative pressure the valve member moves between at least fully closed, partially open and fully open positions. In a partially open position as compared to a fully open position the pressure drop between the points upstream of the valve to the point downstream of the valve is increased. The regulator chamber and an atmospheric chamber are formed in a housing. A diaphragm coupled to the housing, delimits the regulator chamber from the atmospheric chamber. The diaphragm and housing also delimit the atmospheric chamber which is opposite and below the regulator chamber. During operation, the positive atmospheric pressure in the atmospheric chamber can cause a plate and diaphragm and any weights to move upward, the movement causes the valve member to move up thereby placing the valve in a partially open or closed position from an open position or partially open position.

SUMMARY

In the above embodiment the regulator chamber is always open to the crank case emissions by way of a channel in the valve member always open to the crank case emissions receiving port in the regulator housing and always open to the regulator chamber. The regulator is unidirectional. It has a first port which always must serve as the crank case emissions receiving port and a second port which always must serve as the crank case emissions exhaust port.

In one embodiment of the present disclosure a filter is combined with a pressure regulator. The combination includes a primary housing carrying an air/oil separation element. A hollow of the primary housing is partitioned into a first hollow portion and a second portion. A fluid receiving port opens into the first hollow portion and an exhaust port leads out of the second hollow portion. A valve member extends into a throat of the element. The valve member has a fluid receiving hollow, a first fluid aperture opening through a wall of the valve member and into the valve hollow, and a second fluid aperture opening through a wall of the valve member and into said valve hollow. A secondary housing forms a regulator chamber and an atmospheric chamber. A partition of the secondary housing delimits and fluidly seals the atmospheric chamber from the regulator chamber. The partition is moveable in opposite axial directions responsive to a change in a pressure differential between the atmospheric chamber and regulator chamber without the use of a spring. The valve hollow opens into and is in fluid connection with the regulator chamber. The valve hollow is fluidly sealed off from said atmospheric chamber. The valve member is fixedly coupled to the partition of said secondary housing. The secondary housing is carried by the primary housing. A diaphragm forms at least part of said partition which delimits and fluidly seals the atmospheric chamber from the regulator chamber. The combination delimits a fluid pathway wherein fluid received through said fluid receiving port which is exhausted from said exhaust port first enters the first hollow portion, next passes through the first valve aperture, then passes into the valve hollow, then exits the valve hollow through the second valve aperture, then passes into the throat of the element, then passes out of the throat of the element through a wall of the element, and then passes into the second portion of the hollow.

In a further embodiment a closed crankcase emission control system includes a filter, a crankcase, a negative pressure source, and a pressure regulator, and an available clearance height. The pressure regulator includes a housing delimiting an emission void space. A first port opens into the emission void space. A second port opens into the emission void space; the first and second ports are bi directional. A valve body is in the emission void space. The valve body has a channel therein. The valve body has apertures opening into the channel. A diaphragm forms at least part of a partition between an atmospheric and regulator chamber. The atmospheric and regulator chamber are in the housing. The valve body is fixedly coupled to the partition. A fluid pathway is defined wherein emissions enter the first port, then from the first port pass through the valve apertures, from the apertures they enter into the valve channel, and from the valve channel they exit into and out from second port. A port opens out of the regulator chamber and is outside of the valve body. The valve apertures orient to differing partially open positions based on a change in pressure without the aid of a spring. Also the partition moves up and down in the axial direction due to a pressure differential between the regulator chamber and the atmospheric chamber without the aid of a spring.

In still a further embodiment, a filter is combined with a pressure regulator. In this combination a fluid port opens out of the regulator chamber and is outside of the valve body.

BRIEF DESCRIPTION OF THE DRAWINGS

The present invention is described with reference to the following figures.

Figure 1:
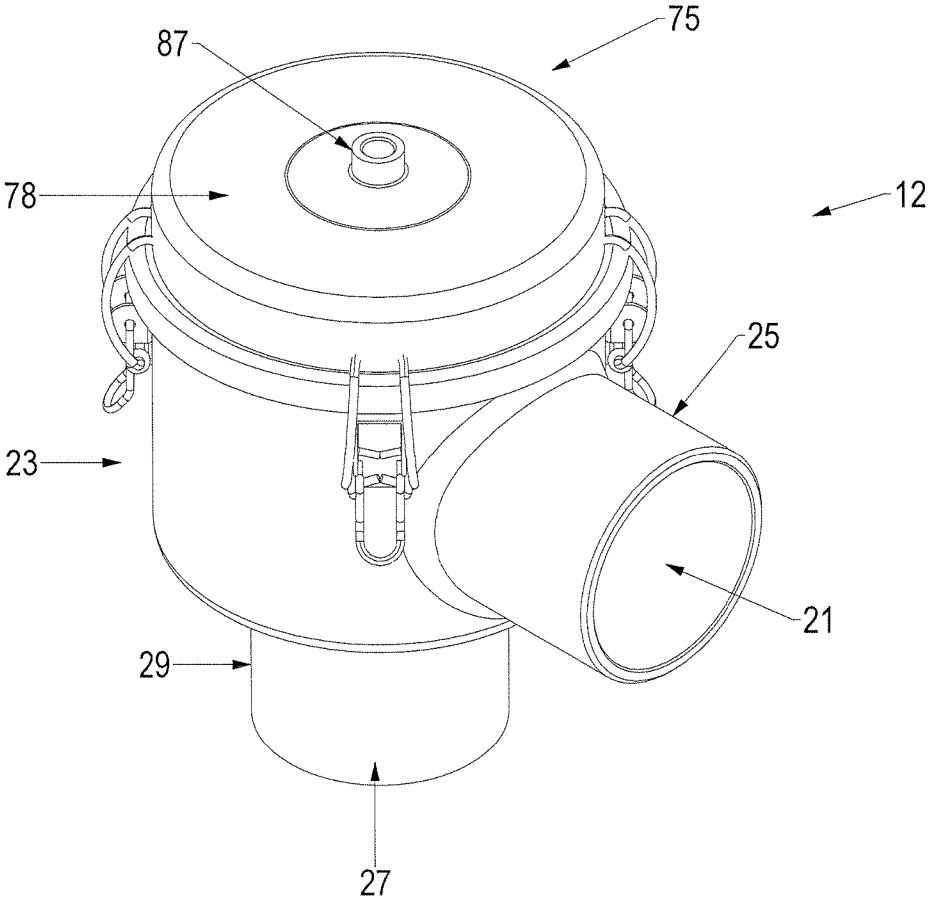
FIG. 1 shows an isometric view of a pressure regulator embodying features of the present invention.

Before any embodiments of the invention are explained in detail, it is to be understood that the invention is not limited in its application to the details of construction and arrangement of components set forth in the following description or as illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 2:
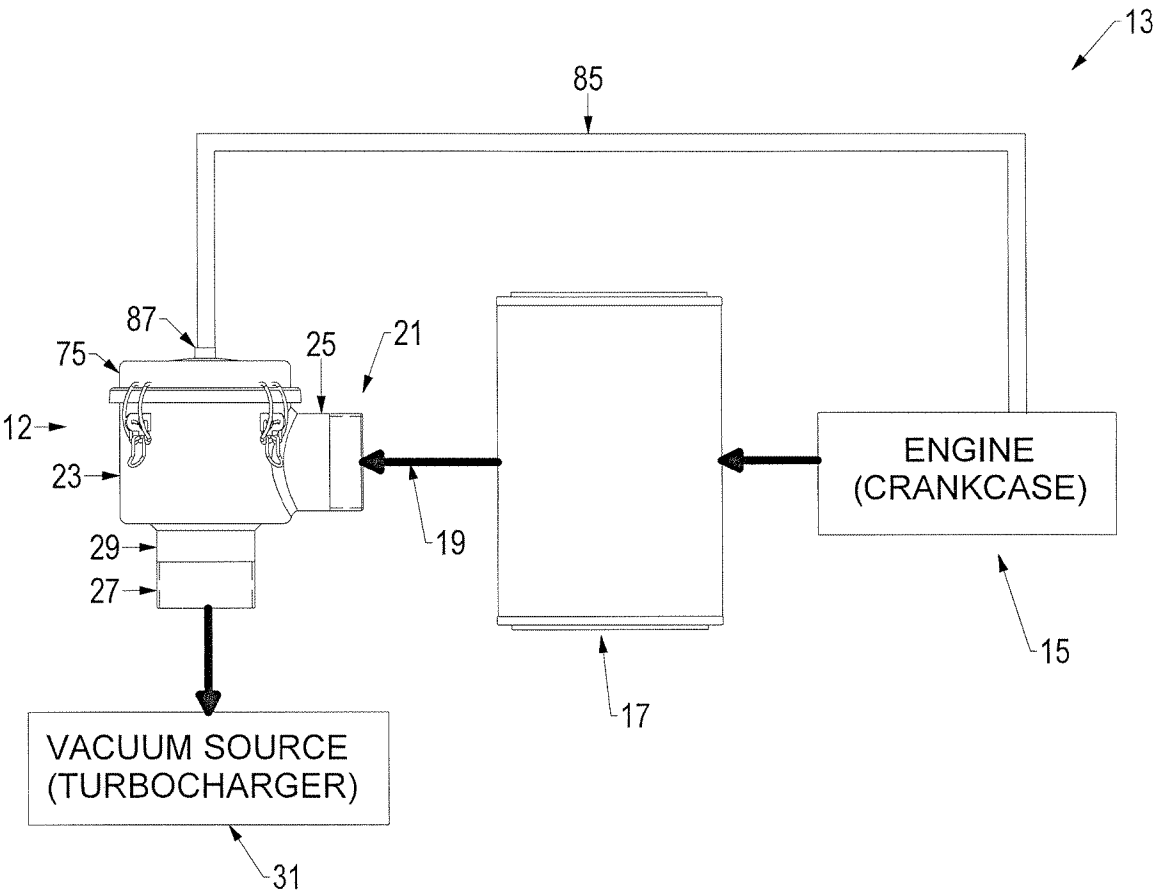
FIG. 2 schematically shows the regulator of FIG. 1 in downstream fluid connection with a crankcase and filter; the regulator is in upstream fluid connection with vacuum source.
Figure 3:
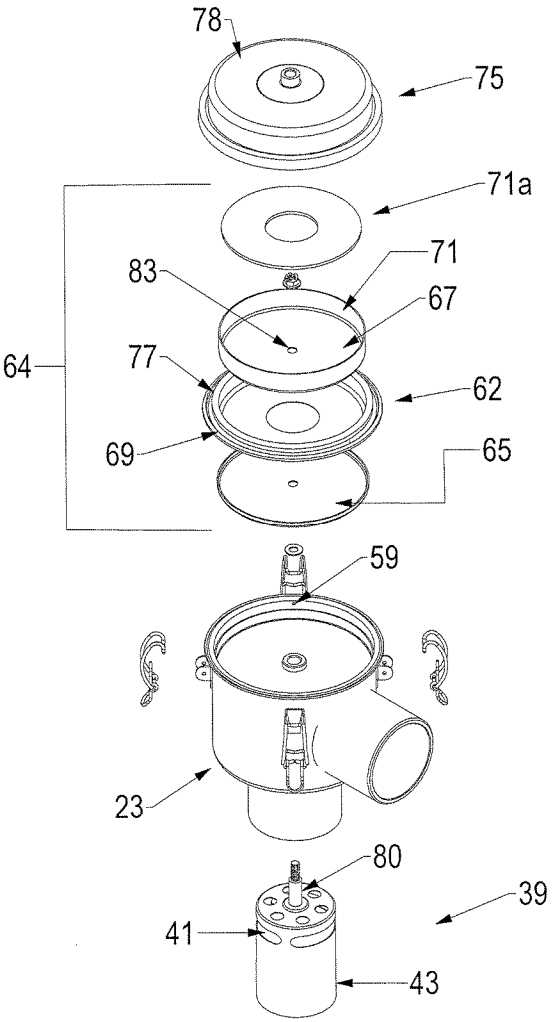
FIG. 3 shows an exploded view of the pressure regulator of FIG. 1.

FIGS. 1, 2 and 3 show an embodiment of the present invention. FIG. 2 shows a pressure regulator assembly 12 used in a closed crankcase emission control system 13. The assembly 12 is in downstream fluid connection with crankcase 15 and the filter 17. Crankcase emissions 19 flow from the crankcase 15 to and through the filter 17 and then from the filter 17 to the pressure regulator assembly 12. The flow into the regulator assembly 12 from the filter 17 is through a first port 21 formed in a portion of regulator housing 23. The first port 21 is at least in part delimited by a first port connector 25 of the regulator housing 23. From the regulator housing 23, the crankcase emissions 19 flow out of a second port 27. They flow into a vacuum source 31 from the second port 27. The second port 27 is at least in part delimited by a second port connector 29. The vacuum source 31 can be a turbocharger. The second port 27 is in upstream fluid connection with the vacuum source 31. The vacuum source 31 can exhaust the filtered emissions 19 back into the engine having the crank case 15 as desired.

Figure 4:
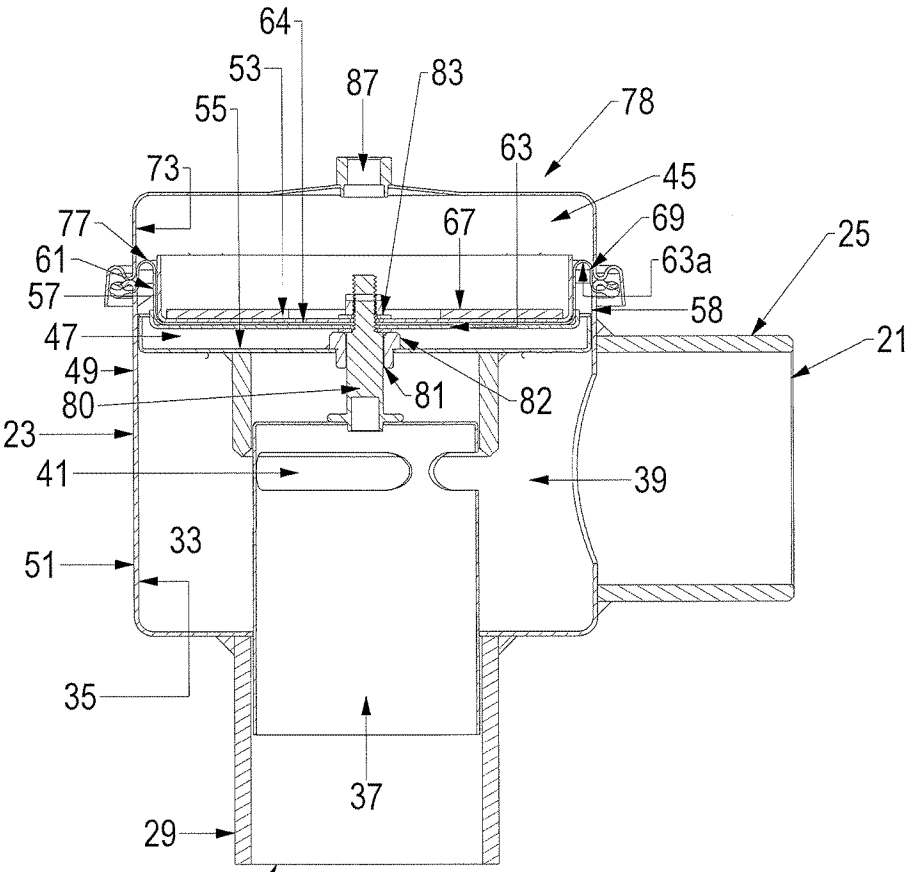
FIG. 4 shows a cross-sectional view of the pressure regulator of FIG. 1.

Looking at FIG. 4 an emissions open void space which can be a cavern 33 is delimited by portions of the regulator housing 23. The cavern places the first port 21 in fluid connection with the second port 27 and the cavern 33 is in fluid connection with both the first and second ports 21, 27. The cavern 33 is a hollow of the housing. The cavern 33 is at least in part delimited by a main body internal wall surface 35 of the housing. The wall surface 35 is curvilinear and continuous except for the ports 21, 27 which open through the wall surface 35. A channel 37 in a valve member 39 guides the emission flow through the cavern 33 from the first port 21 to the second port 27. The channel 37 is thus in fluid connection with the cavern 33 and both the first and second ports 21 and 27. Accordingly the emissions could alternatively flow from the second port 27 to the first port 21. Apertures 41 which open through the valve member main body 43 place the channel 37 in fluid connection with the cavern 33 and both the first and second ports 21, 27.

A regulator chamber 45 and an atmospheric chamber 47 are carried by a first end section 49 of the main body 51 of the housing. The atmospheric chamber 47 at a first end has a delimiting first wall surface 53 which delimits the first end of the chamber 47. The wall surface is formed on a first wall 55. The wall 55 is flat and planar and rigid. The chamber at its sides is also delimited by a first side wall surface 57. The first sidewall surface 57 is rigid and is formed on a sidewall 58 and is curvilinear and circumferential. It is continuous except where apertures 59 open through the sidewall 58. The apertures 59 place the atmospheric chamber 47 in fluid communication with atmosphere or the environment external to the regulator housing. The chamber 47 at its side is also delimited by an elastomeric sidewall surface 61 formed on an elastomer member 62 which is a diaphragm. The atmospheric chamber 47 at a second end has a second delimiting wall surface 63 which delimits the chamber at its second end section. The second wall surface is formed on a second wall 64. The wall surface comprises an elastomeric surface **63*a* formed on the diaphragm 62. It also comprises a rigid surface. The rigid surface is radially inward of the elastomeric surface and is formed on a rigid plate 65 with a planar portion. As explained in more detail below, the void space volume enclosed in the atmospheric chamber 47 increases and decreases as the apertures 41 in the valve member main body 43** carried in the housing orients between at least a closed position, partially open positions, and a fully open position.

The regulator chamber 45, at a first end has a delimiting wall surface 67 which delimits the first end of the chamber 45. The wall surface is formed on the second wall 64. The wall surface comprises an elastomeric surface 69 formed on the diaphragm 62. It also comprises a rigid surface. The rigid surface is radially inward of the elastomeric surface and is formed on a rigid plate 71 with a planar portion. The second wall 64 thus comprises portions of the diaphragm 62, the rigid plate 65 and the rigid plate 71. It also comprises weight **71*a* which can be part of the rigid plate 71. The regulator chamber 45 at its sides is also delimited by a side wall surface 73. The sidewall surface is rigid and is formed on a sidewall and is curvilinear and circumferential. It is continuous. It is a sidewall of a cover 75 which is coupled to the main housing body 51 at the body first end section 49. The chamber 45 at its side is also delimited by an elastomeric sidewall surface 77 formed on the elastomer member 62 which is the diaphragm. The chamber 45 at a second end has a delimiting wall surface which delimits the chamber at its second end. The surface is formed on a wall 78. The wall comprises a rigid surface. The rigid surface is on a rigid planar portion of the cover 75. As explained in more detail below, the void space volume enclosed in the chamber 45** increases and decreases as the apertures 41 in the valve member main body 43 orient between at least the closed position, partially open positions, and fully open position. The regulator chamber 45 is fluidly sealed off from the atmospheric chamber 47. It is fluidly sealed off in part by the wall 64 which is a partition between the atmospheric chamber 47 and the regulator chamber 45.

The regulator chamber 45 is fluidly sealed from the valve member body 43, channel 37 and apertures 41 in the valve member body and cavern 33 to prevent the crankcase emissions 19 received from the crankcase 15 into the cavern 33 from passing from the cavern 33 into the chamber 45. It is also sealed to prevent crankcase emissions 19 received from the crankcase 15 into the channel 37 of the valve member 39 from passing through the channel 37 into the chamber 45. The wall 55, at the first end section 49 of the main housing body 51, seals off the atmospheric chamber 47 from the cavern 33 and channel 37 in the valve. The wall 64 seals off the regulator chamber from the atmospheric chamber and the cavern 33 and channel 37 in the valve to provide the sealing off of the emissions 19 as described above. The valve member 39 has an elongated member 80 which extends through a hole 81 in the wall 55 and a hole 83 in the wall 64. Member 80 extends through a bushing 82 which is in the hole 81 in the wall 55. The bushing 82 provides a seal between the elongated member 80 and hole 81 to prevent the crank case emissions 19 received from the crank case into the cavern 33 from passing from the cavern 33 through the hole 81 or bushing 82 into the chamber 47 and to prevent crankcase emissions 19 received from the crankcase into the channel 37 of the valve from passing from channel 37 through the hole 81 or bushing 82 into the chamber 47. The elongated member 80 is a rod. The member is moveable in the axial direction relative to the wall 55 and bushing 82.

The elongated member 80 is fixedly coupled to a valve main body 43 of the valve 39. The valve main body 43 has the apertures 41. The elongated member 80 is fixedly coupled to wall 64. As the wall 64 moves back and forth in the axial direction without the aid of a spring the valve body 43 moves back and forth in the axial direction without the aid of a spring. The back and forth movement which can be called an up and down movement of the valve body 43 orients the apertures 41 between the closed position, partially open positions, and a fully open position. The apertures 41 move up and down to make sure the negative pressure in the crank case remains at a set predetermined pressure for example negative 3 inches of water. The measurement could be in inches of mercury.

The following example shows in more detail how it works. The desired pressure in the crank case 15 is negative 3 inches. The pressure drop across the filter 17 is negative 2 inches and the negative pressure of the negative pressure source is negative 10 inches. Those in the art frequently refer to the negative pressure source as a vacuum source. The pressure drop across the valve, if left in the fully open position, is negative 2. The valve if left fully open will mean an increase in the crank negative pressure above the desired pressure. The increase is undesirable because it removes to much dirty emissions. To prevent the increase, the regulator valve main body 43 moves upward in the axial direction to orient the aperture from the fully open position to a partially open position. The valve body moves in the axial direction because the atmospheric pressure overcomes the force exerted by the wall 64, which is typically weighted, and moves the wall in the axial direction which pulls the elongated member 80 and valve body 43 in the axial direction which orients the apertures 41 to the partially open position. The apertures open to a partially open position which is within a range of predetermined open positions. The partial opening as compared to the full opening provides an increase in the pressure drop across the valve body 43 to ensure the crankcase pressure, which is referenced by regulator chamber 45 by a fluid line 85 extending from the chamber 45 to the crankcase 15, stays at the desired negative pressure. In this case the pressure in the crank case chamber is at negative 3 inches. If the filter becomes clogged, the pressure drop across the filter increases. Thus the negative pressure in the crank case if the valve were left in place would change to less than negative three inches. It could for instance be negative 1. To prevent the change, the valve main body 43 reorients to place the apertures 41 in a more fully open position. The valve body 43 moves down because the force exerted in the axial direction by the wall 64, which is typically weighted, increases and overcomes the atmospheric force in the atmospheric chamber 47 causing the wall 64 to move in the axial direction. The movement causes the member 80 and valve body 43 to move down which causes the apertures 41 to orient closer to a more fully open position. The change in the size of the opening of the apertures 41 into the cavern 33 provides a decrease in the pressure drop across the valve member to less negative to ensure the crankcase pressure, which is referenced by the regulator chamber 45 through a fluid line 85 extending from the chamber 45 to the crankcase 15, stays at the desired negative pressure.

As understood by the above the apertures orient from a closed position, to partially open positions, to an open position based on a change in pressure without the aid of a spring. The valve is thus spring less. The change in pressure is in the regulator assembly. The wall 64 which is a partition moves up and down in the axial direction due to a pressure differential between the regulator chamber and the atmospheric chamber. The partition moves without the aid of a spring. As the partition moves up and down in the axial directions the valve moves up and down and the valve apertures orient between open, closed and partially open positions. The valve is fixedly coupled to the partition.

The regulator defines a fluid pathway. Emissions enter first port 21, then from the first port 21 pass through the apertures 41, from the apertures 41 they enter into channel 37, from channel 37 they exit into and out from second port 27.

The regulator is configured to provide the first port 21 and first port connector 25 to be bi-directional. The port 21 and connector 25 operate as either a port and connector to receive crankcase emissions or a port and connector to exhaust crankcase emissions. The port 21 and connector 25 comprise an orientation selectable from a group consisting of a crankcase emission receiving port and a crankcase emission exhaust port.

The regulator is configured to provide the second port 27 and second port connector 29 to be bi-directional. The port 27 and connector 29 operate as either a port and connector to receive crankcase emissions or a port and connector to exhaust crankcase emissions. The port 27 and connector 29 comprise an orientation selectable from a group consisting of a crankcase emission receiving port and a crankcase emissions exhaust port.

The regulator chamber 45 has a port 87 which opens into the chamber 45 through an external surface of the regulator housing. It opens through the cover 75. The port 87 is outside the valve body 43, cavern 33 and body 51. A port connector connects the port to line 85. The fluid line 85 is connected to a crank case reference point. The crank case reference point in the present example is the crank case chamber.

The valve body main member 43 has apertures 42 at a first end. The holes allow emissions to escape through the member 43 at the first end. The emissions prevent the first end of the valve member main body from unduly coupling to the wall 55.

Under the old system the filter is mounted downstream of the pressure regulator assembly. Thus the pressure regulator assembly is not available to kill off available negative pressure to the filter. The available negative pressure runs over the filter. Accordingly, the clearance height used must be at least equal to or greater than the available negative pressure divided by the conversion factor. If the height used is less than the available negative pressure divided by the conversion factor then the filter will flood when the system begins operation when the filter is first installed. Thus if the clearance height available for mounting the filter above the high oil level of the crankcase is less than the available negative pressure 31 divided by a conversion factor K the old system cannot be used.

An advantage of the above system 13 is that it can be used when the clearance height available for mounting the filter above the high oil level of the crankcase is less than the available negative pressure 31 divided by a conversion factor K. The system 13 has the pressure regulator downstream of the filter. Thus the pressure regulator is available to kill off available negative pressure. Accordingly, if the clearance height available is less than the available negative pressure divided by the conversion factor than the clearance height used is equal to the clearance height available multiplied by the conversion factor K. If the clearance height available is equal to or greater than the available negative pressure divided by the conversion factor than the clearance height used is equal to the available negative pressure divided by the conversion factor.

Figure 5:
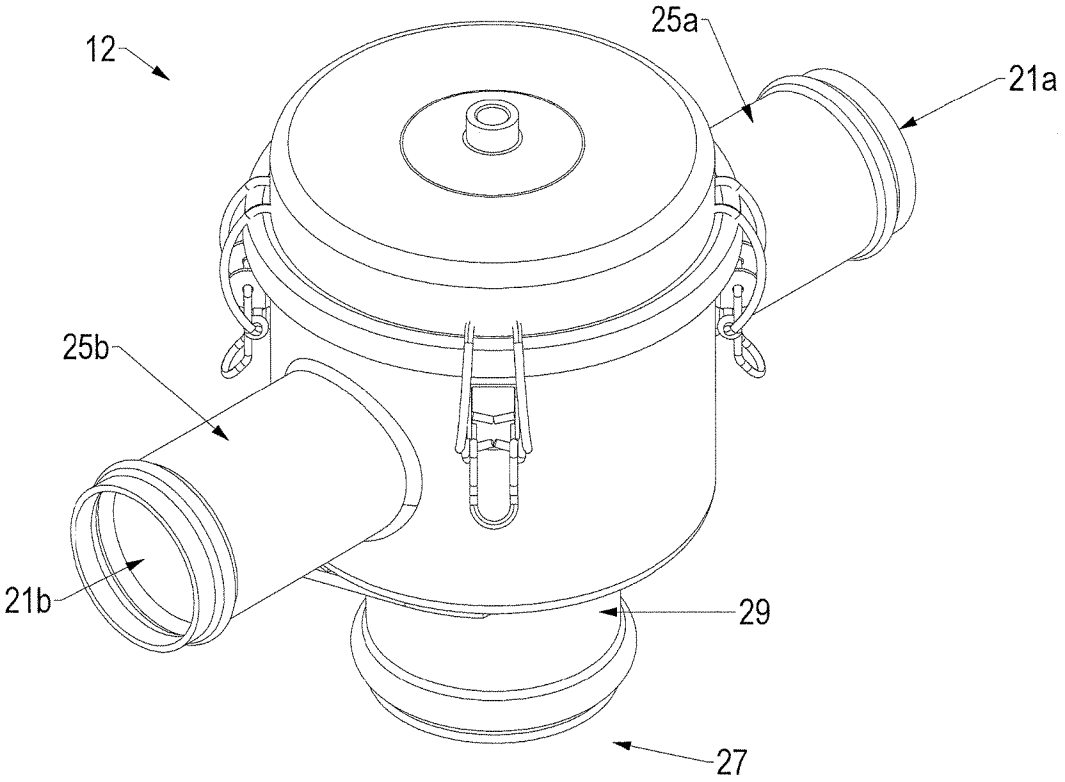
FIG. 5 shows an isometric view an alternative regulator assembly embodying features of the present invention.
Figure 6:
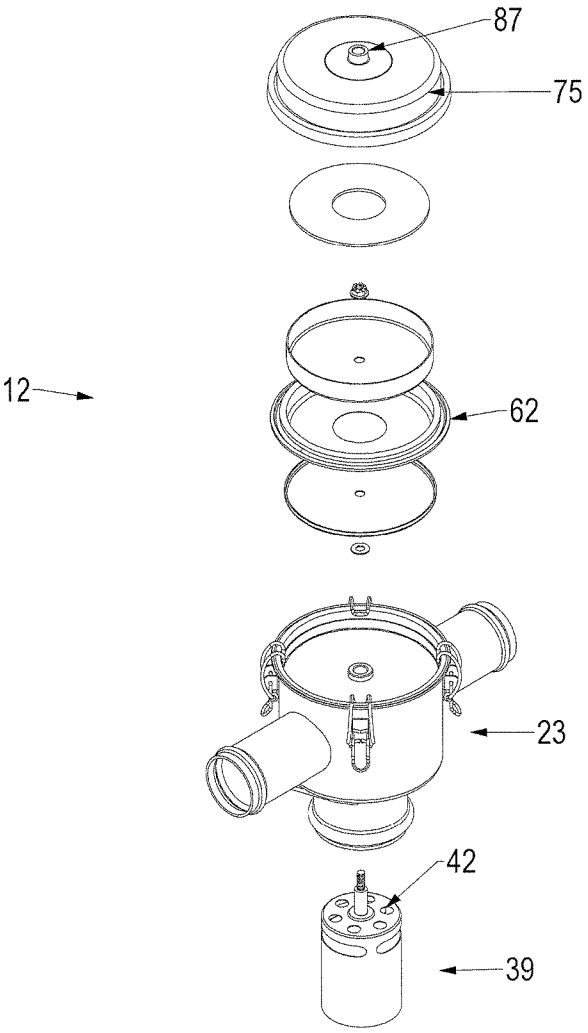
FIG. 6 shows an exploded view of the pressure regulator of FIG. 5.
Figure 7:
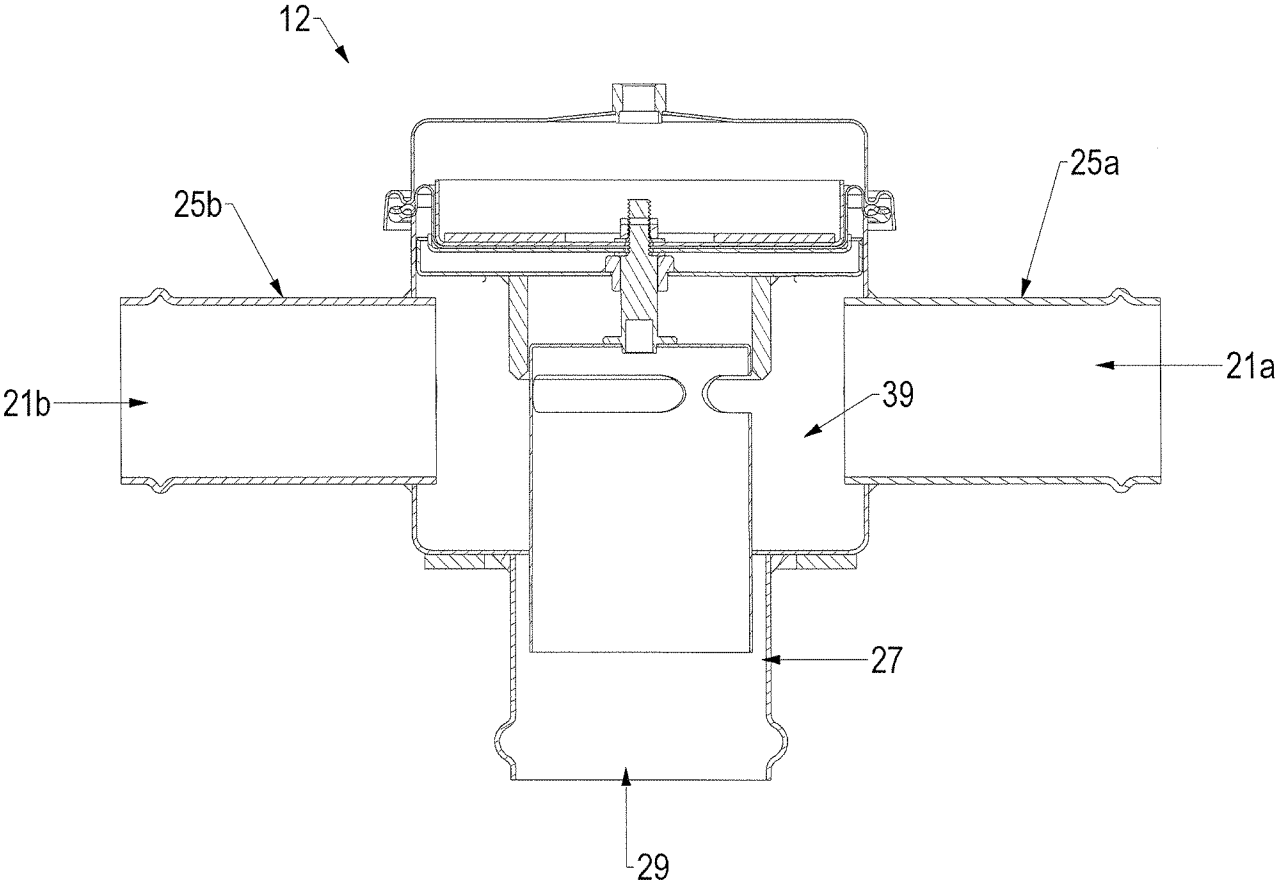
FIG. 7 shows a cross-sectional view of the pressure regulator of FIG. 5.

FIGS. 5-7 show a further embodiment of a pressure regulator which embodies features of the present invention. The embodiment is the same as the embodiment shown in FIGS. 1-3 except the embodiment shown in FIGS. 5-7 has a pair of first ports 21*a*, 21*b* and connectors 25*a*, 25*b*. The first 21*a*, 21*b* and second 27 ports and connectors 25*a*, 25*b*, and 29 have the same bidirectional features as the ports and connectors in FIGS. 1-3.

Figure 8:
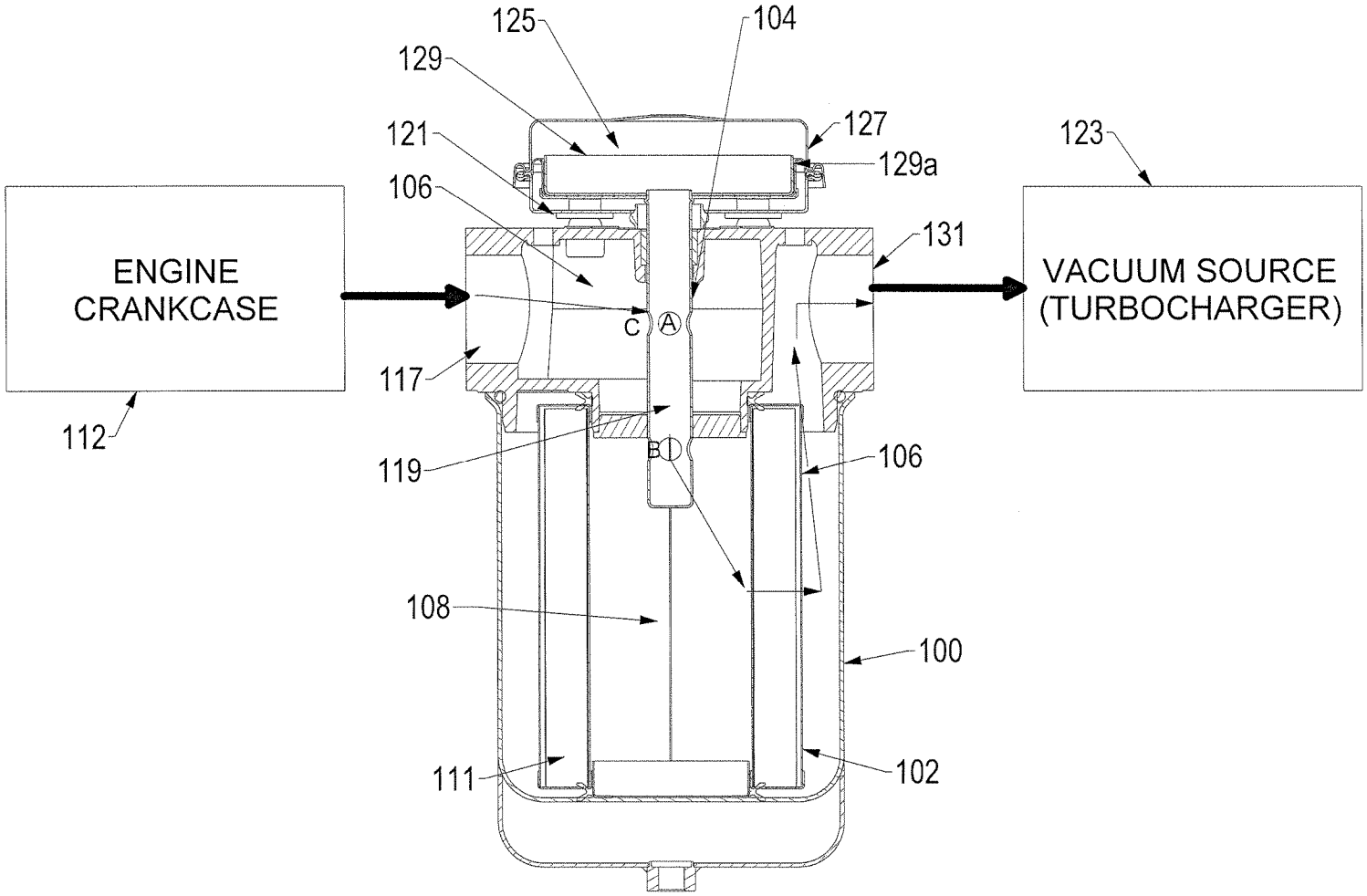
FIG. 8 shows a cross-sectional view of an alternative embodiment of a pressure regulator assembly having a single primary housing to carry a valve member and a filter element.

FIG. 8 shows still a further embodiment of a pressure regulator in combination with a filter which embodies further features of the invention. The combination uses a single primary housing 100 to carry an air/oil separation element 102 (type of filter element) and receive the valve member 104 which opens between at least a fully open, partially open positions and a closed poison. The element 102 is disposed in a hollow 106 of the housing 100. The valve member 104 is disposed in the throat 108 of the element. Emissions 110 are received in the housing 100 from the crank case 112, pass into the throat 108 of the element 102, pass through a filtering sidewall 11 of the element and out the housing to the vacuum source. The emissions 110 are received in a first hollow portion of the hollow 106 of the housing from the crank case 112 through an emissions receiving port 117 and emissions receiving connector 118 of the housing 100. Emissions 110 are exhausted from a second portion of the hollow 106 after first passing through a hollow 119 in the valve member. The emissions are received into the hollow 119 from aperture A in the member 104. The emissions 110 then pass out from the hollow 119 through aperture B. From aperture B they pass through the filter element 102 into second hollow portion of hollow 106. From the second portion of hollow 106 they pass into and through the exhaust port 131 of the pressure regulator assembly. Hollow 106 is partitioned into the first and second portion to require all emissions which pass into the second hollow portion from the first hollow portion to pass through aperture A, hollow 119, and then aperture B. Aperture A is always open to the regulator chamber 125 and the crank case 112 and hollow 119 in the valve member 104. Aperture B in valve member 104 is always open to the regulator chamber 125 and crank case 112. It is also open to the vacuum source 123 when in the open position and closed off from the vacuum source 123 when in the closed position. The regulator chamber 125 and the atmospheric chamber 121 are formed in a secondary housing 127 carried by the primary housing 100. A diaphragm 129*a* coupled to the secondary housing 127, as part of a partition 129, delimits the atmospheric chamber and regulatory chamber 125. The atmospheric chamber 121 is opposite and below the regulatory chamber 125. When the positive atmospheric pressure in the atmospheric chamber 121 exceeds the force of the partition 129 and any added weight exerted in the axial direction, the diaphragm 129*a* and rest of the partition 129 move upward in an axial direction, the movement can cause the valve member 104 to move up thereby reorienting the Aperture B from an open to a partially open position. The partition 129 is fixedly coupled to the valve member and moves up and down in opposite axial directions with the valve member. The present embodiment has rigid plates like the plates 65 and 71. It also has a diaphragm like diaphragm 62. The primary difference is that the valve in the present embodiment does not open through the partition 129. The atmospheric chamber 121 is in fluid communication with atmosphere by way of apertures opening through a side wall of the secondary housing 127. The aperture B when in the partially open position, is at least in the throat of the element and adjacent a collar in the throat. The aperture changes from a closed position, to partially open potions, and to a fully open position responsively for the reasons described above with respect to the regulator of FIGS. 1-4. The filter element thus has an opening delimited by a collar at an axial end portion of the element. The opening is adapted to receive slidable member 104.

The regulator of FIG. 8 could be modified to replace the valve member with a modified member. The modified member at point C would have an elongated member like the elongated member 80. The modified valve member at point C would have apertures at around point A. These apertures would serve the function of apertures 41. The modified valve would not have the apertures at point B. There would be no opening at point B. The regulator chamber 125 would be placed in fluid communication with a port and line like that of port 87 and line 85.

Figure 9:
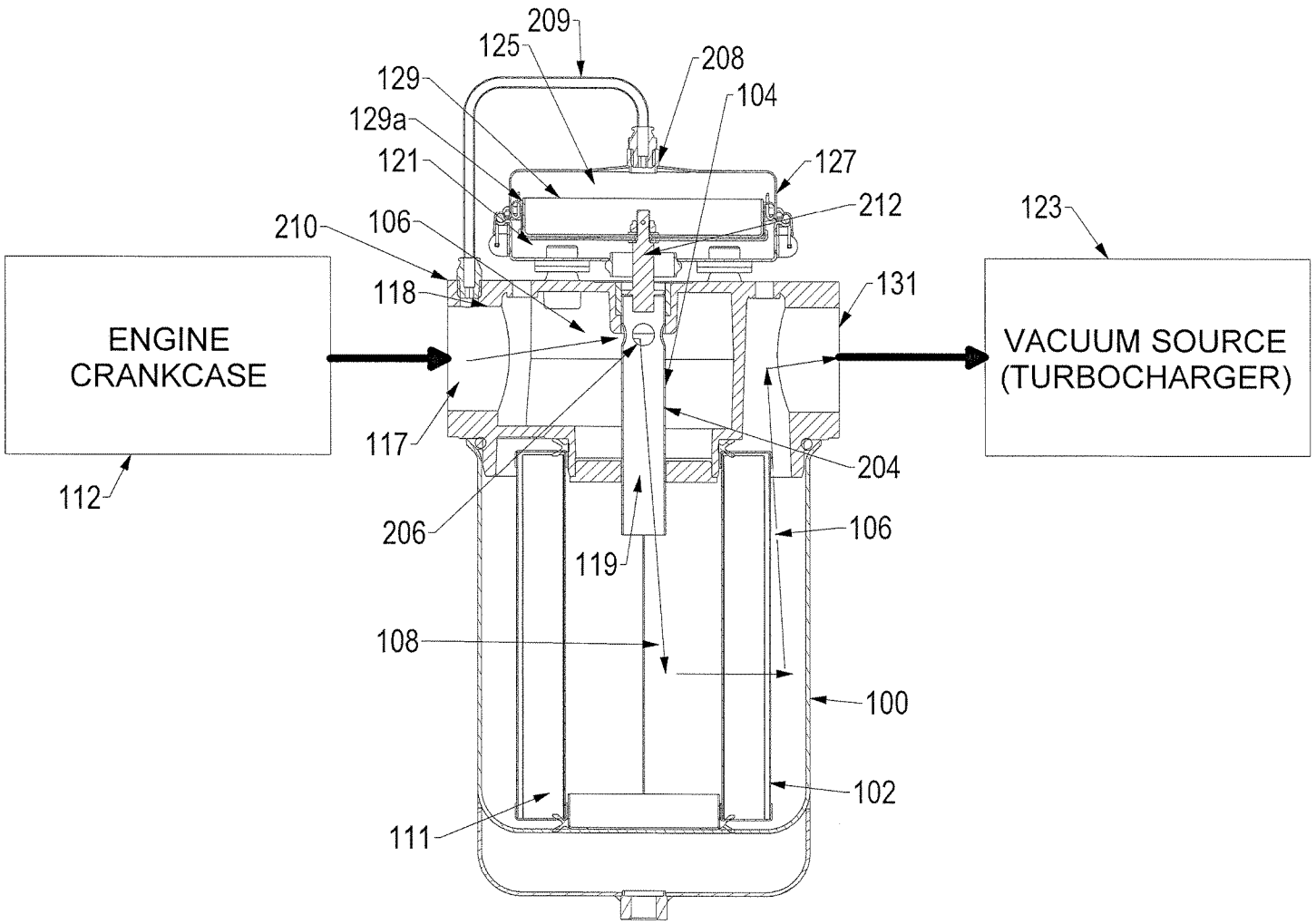
FIG. 9 shows a cross-sectional view of an alternative embodiment of a pressure regulator assembly having a single primary housing to carry a valve member and a filter element.

FIG. 9 shows the modified valve of FIG. 8. The valve member 104 has a valve body 204. The body 204 is similar to body 43. The member 204 has apertures 206. The apertures 206 are similar to apertures 41. A rod 212 similar to rod 80 extends from the main body valve member 204. The regulator chamber 1 has a port 208 opening into the regulator chamber 125. The port is similar to port 87. A fluid line 209 is in fluid connection to the port 208 and places the port 208 and chamber 125 in fluid connection with a crank case reference point. In this case the reference point 210 is at the exhaust port 131 of the pressure regulator assembly. The pressure regulator and valve are substantially similar to the pressure regulator and valve in FIGS. 1-4 except the receiving port, emissions port, and valve member are in the filter housing.

The above described embodiment of the invention is intended to be illustrative only. Numerous alternative embodiments may be devised by those skilled in the art without departing from the spirit and scope of the following claims.

The invention claimed is:

1. A filter in combination with a pressure regulator comprising:

a primary housing carrying an air/oil separation element;

a hollow of said primary housing partitioned into a first hollow portion and a second portion;

a fluid receiving port opening into said first hollow portion and an exhaust port leading out of said second hollow portion;

a valve member extends into a throat of the element, said valve member having a fluid receiving hollow, a first fluid aperture opening through a wall of said valve member and into said valve hollow, a second fluid aperture opening through a wall of said valve member and into said valve hollow;

a secondary housing forming a regulator chamber and an atmospheric chamber, a partition of said secondary housing delimits and fluidly seals the atmospheric chamber from the regulator chamber, said partition is moveable in opposite axial directions responsive to a change in a pressure differential between the atmospheric chamber and regulator chamber without the use of a spring, said valve hollow opens into and is in fluid connection with said regulator chamber, said valve hollow is fluidly sealed off from said atmospheric chamber, said valve member is fixedly coupled to said partition of said secondary housing, said secondary housing is carried by the primary housing;

a diaphragm forming at least part of said partition which delimits and fluidly seals the atmospheric chamber from the regulator chamber;

a fluid pathway wherein fluid received through said fluid receiving port which is exhausted from said exhaust port first enters the first hollow portion, next passes through the first valve aperture, then passes into the valve hollow, then exits the valve hollow through the second valve aperture, then passes into the throat of the element, then passes out of the throat of the element through a wall of the element, then passes into the second portion of the hollow.

2. A filter in combination with a pressure regulator of claim 1 wherein the first aperture is always open to the regulator chamber.

3. A filter in combination with a pressure regulator of claim 2 wherein the second aperture is moveable between an open position, closed position and partially open positions, in the closed position the second aperture is closed to the exhaust port, in the open position is fully open to the exhaust port, and in the partially closed positions is partially closed to the exhaust port.

4. A filter in combination with a pressure regulator of claim 3 wherein the atmospheric chamber is opposite and below the regulator chamber.

5. A filter in combination with a pressure regulator of claim 4 wherein the secondary housing is atop the primary housing.

6. A filter in combination with a pressure regulator comprising:

a primary housing carrying an air/oil separation element;

a hollow of said primary housing partitioned into a first hollow portion and a second portion;

a fluid receiving port opening into said first hollow portion and an exhaust port leading out of said second hollow portion;

a valve member extends into a throat of the element, said valve member having a fluid receiving hollow, and fluid aperture opening through a wall of said valve member and into said valve hollow, said fluid aperture outside of said throat and upstream of said element;

a secondary housing forming a regulator chamber and an atmospheric chamber, a partition of said secondary housing delimits and fluidly seals the atmospheric chamber from the regulator chamber, said partition is moveable in opposite axial directions responsive to a change in a pressure differential between the atmospheric chamber and regulator chamber without the use of a spring, said valve hollow opens into and is in fluid connection with said regulator chamber, said valve hollow is fluidly sealed off from said atmospheric chamber, said valve member is fixedly coupled to said partition of the secondary housing, said secondary housing is carried by the primary housing;

a diaphragm forming at least part of said partition which delimits and fluidly seals the atmospheric chamber from the regulator chamber;

a fluid pathway wherein fluid received through said fluid receiving port which is exhausted from said exhaust port first enters the first hollow portion, next passes through the first valve aperture, then passes into the valve hollow, then exits the valve hollow into the throat of the element, then passes out of the throat of the element through a wall of the element, then passes into the second portion of the hollow wherein the aperture is moveable between an open position, closed position and partially open positions, in the closed position the aperture is closed to the exhaust port, in the open position is fully open to the exhaust port, and in the partially closed position is partially closed to the exhaust port a fluid port opens out of the regulator chamber and is outside of the valve body.

7. A closed crankcase emission control system comprising a filter, a crankcase, a negative pressure source, and a pressure regulator, said pressure regulator comprising:

a housing delimiting an emission void space;

a first port opening into said emission void space;

a second port opening into said emission void space, said first and second ports bi directional;

a valve body in said emission void space, said valve body having a channel therein, said valve body having apertures opening into the channel;

a diaphragm forming at least part of a partition between an atmospheric and regulator chamber, said atmospheric and regulator chamber in the housing, said valve body fixedly coupled to the partition;

a fluid pathway wherein emissions enter the first port, then from the first port pass through the valve apertures, from the apertures they enter into the valve channel, from the valve channel they exit into and out from second port;

a port opens out of the regulator chamber and is outside of the fluid pathway;

wherein the valve apertures orient to differing partially open positions based on a change in pressure without the aid of a spring;

wherein the partition moves up and down in the axial direction due to a pressure differential between the regulator chamber and the atmospheric chamber without the aid of a spring.

8. A closed crankcase emission control system of claim 7 wherein the regulator is mechanical.

9. A closed crankcase emission control system of claim 8 wherein said pressure regulator is mounted downstream of the filter enabling the regulator to kill off available negative pressure to the filter and allow the mounting of the filter at a smaller clearance height above the high oil level as compared to the clearance height needed if the filter is downstream of the regulator.

10. A closed crankcase emission control system of claim 8 wherein the pressure regulator is downstream of the filter.

11. A pressure regulator comprising:

a housing delimiting an emission void space;

a first port opening into said emission void space;

a second port opening into said emission void space, said first and second ports bi directional;

a valve body in said emission void space, said valve body having a channel therein, said valve body having apertures opening into the channel;

a diaphragm forming at least part of a partition between an atmospheric and regulator chamber, said atmospheric and regulator chamber in the housing, said valve body fixedly coupled to the partition;

a fluid pathway wherein emissions enter the first port, then from the first port pass through the valve apertures, from the apertures they enter into the valve channel, from the valve channel they exit into and out from second port;

a port opens out from the regulator chamber and is outside of the fluid pathway;

wherein the valve apertures orient to differing partially open positions based on a change in pressure without the aid of a spring and;

wherein the partition moves up and down in the axial direction due to a pressure differential between the regulator chamber and the atmospheric chamber without the aid of a spring.

* * * * *